US010340620B2

(12) United States Patent
Ogura

(10) Patent No.: US 10,340,620 B2
(45) Date of Patent: Jul. 2, 2019

(54) MULTI-CONTACT CONNECTOR

(71) Applicant: IRISO ELECTRONICS CO., LTD., Kanagawa (JP)

(72) Inventor: Yoshiyuki Ogura, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 15/924,485

(22) Filed: Mar. 19, 2018

(65) Prior Publication Data

US 2018/0309220 A1 Oct. 25, 2018

(30) Foreign Application Priority Data

Mar. 30, 2017 (JP) ..... 2017-066932

(51) Int. Cl.

| | |
|---|---|
| ***H01R 24/00*** | (2011.01) |
| ***H01R 13/41*** | (2006.01) |
| ***H01R 13/26*** | (2006.01) |
| ***H01R 12/73*** | (2011.01) |
| ***H01R 12/71*** | (2011.01) |
| ***H01R 13/24*** | (2006.01) |
| *H01R 12/57* | (2011.01) |

(52) U.S. Cl.

CPC ..... *H01R 13/41* (2013.01); *H01R 12/712* (2013.01); *H01R 12/737* (2013.01); *H01R 13/2492* (2013.01); *H01R 13/26* (2013.01); *H01R 12/57* (2013.01)

(58) Field of Classification Search

CPC ..... H01R 23/7068; H05K 7/1069; H05K 7/1084; G06K 7/0021

USPC ..... 439/60, 62, 68, 70, 630, 637

See application file for complete search history.

(56) References Cited

U.S. PATENT DOCUMENTS

| | | | | |
|---|---|---|---|---|
| 5,024,609 | A | 6/1991 | Piorunneck | |
| 5,239,748 | A * | 8/1993 | Hamilton | H05K 1/117 29/843 |
| 5,496,180 | A * | 3/1996 | Fabian | H01R 4/028 439/60 |
| 5,813,883 | A * | 9/1998 | Lin | H01R 12/721 439/637 |

(Continued)

FOREIGN PATENT DOCUMENTS

| | | |
|---|---|---|
| JP | 47-41714 | 10/1972 |
| JP | 56-61777 A | 5/1981 |

(Continued)

OTHER PUBLICATIONS

Office Action from Japanese Patent App. No. 2017-066932 (dated Jan. 26, 2018).

*Primary Examiner* — Thanh Tam T Le

(74) *Attorney, Agent, or Firm* — Cermak Nakajima & McGowan LLP; Tomoko Nakajima

(57) ABSTRACT

An object is to reduce the size of a multi-contact connector having a wiping function. A multi-contact connector includes a front terminal and a rear terminal. The front terminal and the rear terminal are independently housed in one terminal accommodating groove in a housing in such a manner as to separate from each other. Unlike terminals of a multi-contact connector according to the related art, each terminal has no junction where it divides into a front contact and a rear contact. The housing requires no space for accommodating such a junction, and this reduces the size of the multi-contact connector.

4 Claims, 6 Drawing Sheets

(56) References Cited

U.S. PATENT DOCUMENTS

| | | | | | |
|---|---|---|---|---|---|
| 5,820,392 | A * | 10/1998 | Lin | H01R 12/721 | 439/108 |
| 5,876,214 | A * | 3/1999 | McHugh | H01R 12/721 | 439/60 |
| 6,439,930 | B1 * | 8/2002 | Korsunsky | H01R 12/716 | 439/60 |
| 7,607,949 | B2 * | 10/2009 | Hsu | H01R 12/716 | 439/267 |
| 9,065,225 | B2 * | 6/2015 | Degner | H01R 12/721 | |
| 2002/0022381 | A1 | 2/2002 | Ito et al. | | |
| 2009/0209142 | A1 | 8/2009 | Sasaoka et al. | | |
| 2016/0043494 | A1 | 2/2016 | Mashiyama et al. | | |

FOREIGN PATENT DOCUMENTS

| | | | |
|---|---|---|---|
| JP | 5-242937 | A | 9/1993 |
| JP | 2001-023711 | A | 1/2001 |
| JP | 2002-056910 | A | 2/2002 |
| JP | 2009-199766 | A | 9/2009 |
| JP | 2016-173998 | A | 9/2016 |

* cited by examiner

MULTI-CONTACT CONNECTOR

BACKGROUND OF THE INVENTION

1. Field of the Invention

The present invention relates to a multi-contact connector in which a front contact of a front terminal and a rear contact of a rear terminal are configured to contact a connection object.

2. Description of the Related Art

Connection reliability is a fundamental characteristic required for connectors. To improve connection reliability, multi-contact connectors have been developed, which include a front terminal with a front contact and a rear terminal with a rear contact and have a wiping function of wiping off foreign matter (see Japanese Unexamined Patent Application Publication No. 2001-23711 (e.g., FIGS. 2, 3, and 8), Japanese Unexamined Patent Application Publication No. 2016-173998 (e.g., FIGS. 1 and 4), and Japanese Examined Patent Application Publication No. 47-41714 (e.g., FIGS. 11 to 13)). A multi-contact connector is configured in such a manner that after the front contact of the front terminal contacts a connection object, the rear contact of the rear terminal located on a line extending from the front contact in the insertion direction of the connection object contacts the connection object. This means that the rear contact contacts the connection object after the front contact removes foreign matter adhering to the connection object. It is thus possible to achieve a highly reliable electrical connection.

Examples of the terminal structure including the front contact and the rear contact are described in Japanese Unexamined Patent Application Publication No. 2001-23711 and Japanese Unexamined Patent Application Publication No. 2016-173998. In these examples, each terminal has a junction where it bends in the middle thereof in the longitudinal direction and divides into a front contact and a rear contact. In this terminal structure, the presence of junctions increases the size of terminals, and thus increases the size of the multi-contact connector which houses the terminals. It is difficult to reduce the size of the junctions, which are typically produced by bending in the molding process.

Another terminal structure is described in Japanese Examined Patent Application Publication No. 47-41714. In this example, a front terminal with a front contact and a rear terminal with a rear contact, which are provided separately, are combined together to form a single terminal. Manufacturing this terminal requires the step of combining together the front terminal and the rear terminal, which are separate components. The assembly process which involves combining the front terminal and the rear terminal together tends to cause variation in the dimensional accuracy of the resulting terminal and this make it difficult to achieve a size reduction.

SUMMARY OF THE INVENTION

The present invention has been made on the background of the related art described above. An object of the present invention is to reduce the size of a multi-contact connector having a wiping function.

To achieve the object described above, the present invention is configured as one having the following features.

That is, the present invention provides a multi-contact connector including a housing having a fitting chamber into which a connection object is to be inserted; a front terminal including a flat plate-like front extending portion held by the housing, and a front contact configured to contact the connection object inserted into the fitting chamber; and a rear terminal including a flat plate-like rear extending portion held by the housing, and a rear contact located on a line extending from the front contact in an insertion direction of the connection object. The housing has one terminal accommodating groove communicating with the fitting chamber and configured to accommodate the front terminal and the rear terminal together in such a manner that the front terminal and the rear terminal are in a separate state. The front terminal and the rear terminal include respective substrate connecting portions extending from the terminal accommodating groove and electrically connected to one circuit contact point on a substrate.

In the multi-contact connector described above, after the front contact of the front terminal contacts the connection object, the rear contact of the rear terminal located on the line extending from the front contact in the insertion direction of the connection object contacts the connection object. Thus, since the rear contact contacts the connection object after the front contact removes foreign matter adhering to the connection object, a highly reliable electrical connection is achieved.

Also, the front terminal and the rear terminal are independently housed in one terminal accommodating groove in the housing in such a manner as to separate from each other. Unlike in the case of a multi-contact connector of the related art in which each terminal extending from the proximal side divides into a front contact and a rear contact at a junction in the middle thereof, the housing requires no space for accommodating such a junction, and this reduces the size of the multi-contact connector. Additionally, the terminal structure without such a junction is simple and easy to manufacture.

Also, the front terminal and the rear terminal include respective substrate connecting portions extending from the terminal accommodating groove and electrically connected to one circuit contact point on the substrate. The substrate connecting portion of the front terminal and the substrate connecting portion of the rear terminal are thus independently electrically connected to one circuit contact point. Therefore, even if the substrate connecting portion of one of the front and rear terminals fails to make contact with the circuit contact point, the other substrate connecting portion can maintain the electrical connection and this makes it possible to maintain high connection reliability. As described above, the substrate connecting portion of the front terminal and the substrate connecting portion of the rear terminal are electrically connected to one circuit contact point. Such an electrical connection is made, for example, by soldering. Since the substrate connecting portions of the front and rear terminals can be soldered together, the peeling strength of the soldering portion can be improved.

According to an aspect of the present invention, the substrate connecting portion of the front terminal and the substrate connecting portion of the rear terminal may each include a contact portion soldered to the circuit contact point and a leg extending from the terminal accommodating groove to the contact portion. The leg of the front terminal and the leg of the rear terminal may partly extend in directions different from each other.

Ideally, the connection object is inserted in a straight line into the fitting chamber. However, the connection object is often inserted at an angle in a three-dimensional direction into the fitting chamber, and insertion forces of the connection object from various directions act on the multi-contact connector. If the leg of the front terminal and the leg of the rear terminal have the same shape, all the legs deform in the same way and this makes it difficult for the legs to accommodate the insertion forces from various directions. This may result in concentration of stress on the soldering portion that secures the contact portions to the circuit contact point, and may produce defects, such as cracks.

In the front terminal and the rear terminal according to the aspect of the present invention described above, however, the leg of the front terminal and the leg of the rear terminal partly extend in directions different from each other. Therefore, even if the connection object is inserted at an angle, at least one of the legs partly extending in different directions stretches to accommodate the insertion force. This relieves the insertion force acting on the soldering portion.

According to another aspect of the present invention, the terminal accommodating groove may be configured to accommodate the front terminal and the rear terminal in such a manner that a flat surface of the front extending portion and a flat surface of the rear extending portion extend along a width direction of the terminal accommodating groove and face each other.

The terminal accommodating groove according to this aspect of the present invention is configured to accommodate the front terminal and the rear terminal in such a manner that the flat surface of the front extending portion and the flat surface of the rear extending portion extend along the width direction of the terminal accommodating groove and face each other. This makes the multi-contact connector smaller in size than the multi-contact connector in which the terminal accommodating groove accommodates the front terminal and the rear terminal in such a manner that the flat surface of the front extending portion and the flat surface of the rear extending portion are arranged side by side, in their surface direction, along the depth or width direction of the terminal accommodating groove.

According to another aspect of the present invention, the terminal accommodating groove may have a rear-terminal securing groove and a front-terminal securing groove. The rear-terminal securing groove is disposed adjacent to an opening of the terminal accommodating groove communicating with the fitting chamber, and is configured to allow the rear extending portion to be press-fitted thereinto in such a manner that a surface of the rear extending portion extends along a width direction of the terminal accommodating groove. The front-terminal securing groove is disposed closer to a bottom surface of the terminal accommodating groove than the rear-terminal securing groove is, and is configured to allow the front extending portion to be press-fitted thereinto in such a manner that a surface of the front extending portion extends along the width direction of the terminal accommodating groove.

In the housing according to this aspect of the present invention, the front extending portion is press-fitted into and secured to the front-terminal securing groove and the rear extending portion is press-fitted into and secured to the rear-terminal securing groove. Since the rear terminal can be housed in a position adjacent to the fitting chamber of the terminal accommodating groove and the front terminal can be housed in a position adjacent to the bottom surface of the terminal accommodating groove, it is possible to reduce the size of the multi-contact connector.

The rear extending portion may have distal-side rear securing bulges formed adjacent to the rear contact and secured to the housing, and proximal-side rear securing bulges formed adjacent to the substrate connecting portion. The distal-side rear securing bulges may be formed to be longer than the proximal-side rear securing bulges in the length direction of the rear extending portion.

In the rear terminal according to this aspect of the present invention, the rear extending portion is reliably secured to the housing at multiple points, that is, at the distal-side rear securing bulges and the proximal-side rear securing bulges. As described above, the distal-side rear securing bulges adjacent to the rear contact are formed to be longer than the proximal-side rear securing bulges in the length direction of the rear extending portion. Therefore, even when high contact pressure of the rear contact acts on the connection object, the distal-side rear securing bulges having a longer securing length firmly supports the proximal side of the rear contact which creates high contact pressure.

The multi-contact connector according to any aspect of the present invention not only achieves connection reliability by providing the function of wiping off foreign matter, but also reduces its overall size by independently and separately accommodating the front terminal and the rear terminal in one terminal accommodating groove.

DESCRIPTION OF THE PREFERRED EMBODIMENTS

Figure 1:
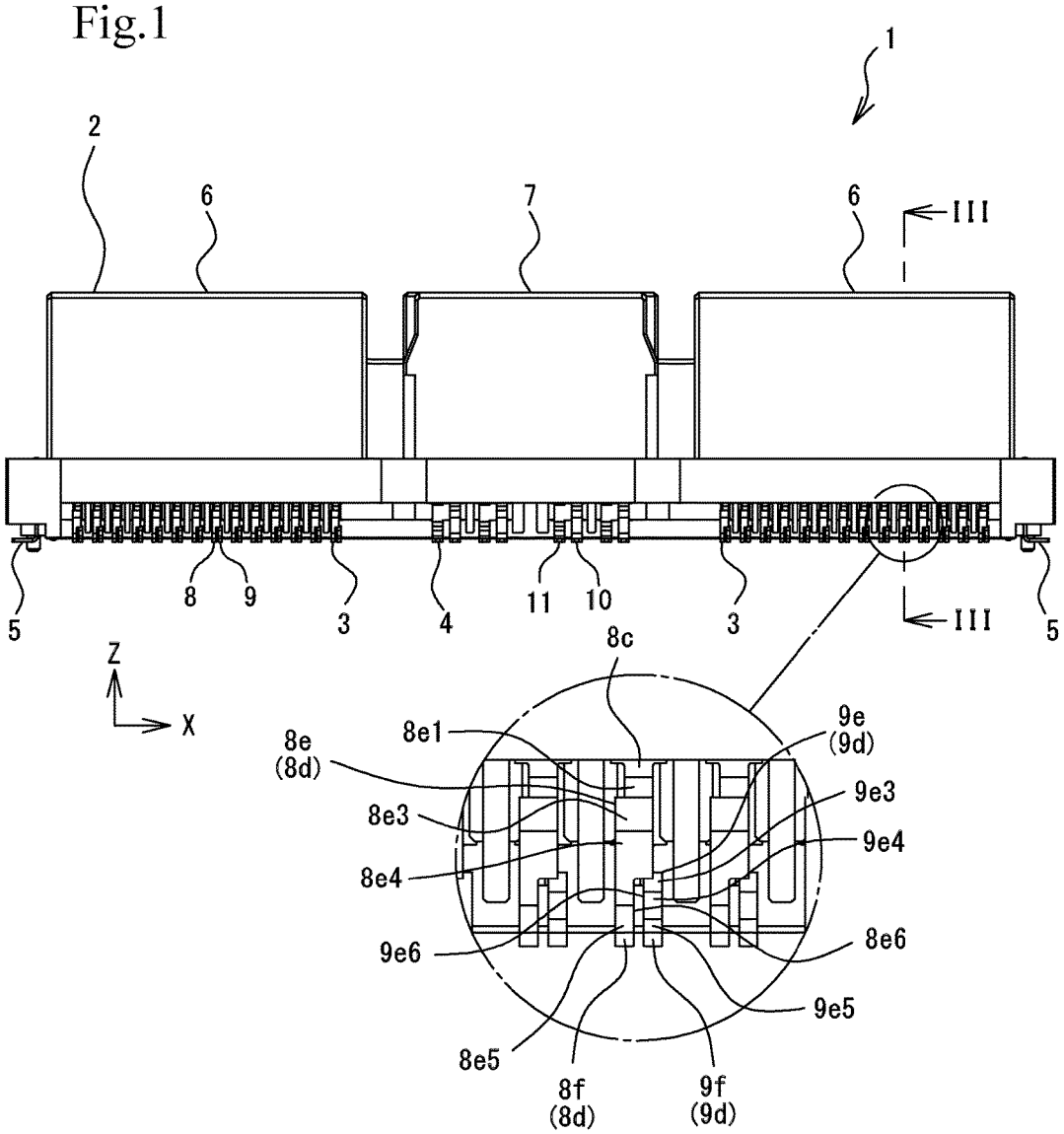
FIG. 1 is a front view of a multi-contact connector according to an embodiment.

Hereinafter, an embodiment of a multi-contact connector according to the present invention will be described with reference to the drawings. Throughout the present specification and claims, the width direction, the depth direction (front-rear direction), and the height direction (up-down direction) of the multi-contact connector may be referred to as the X direction, the Y direction, and the Z direction, respectively, for convenience of explanation, but they are not intended to limit how the multi-contact connector is mounted and used.

A multi-contact connector 1 includes a housing 2, a plurality of signal multi-contact terminals 3, a plurality of power multi-contact terminals 4, and a plurality of metal fasteners 5. The multi-contact connector 1 is mounted and secured by being soldered onto a substrate P. The multi-contact connector 1 thus electrically connects a connection object to a circuit on the substrate P. In the present embodiment, the multi-contact connector 1 is configured as a socket connector, and the "connection object" is a plug connector (hereinafter referred to as "target connector"). The "connection object" is not limited to a connector, such as a plug connector, and may be a flat conductor (e.g., hard substrate, flexible printed circuit (FPC), or flat flexible cable (FFC)) or a terminal (e.g., pin terminal).

Figure 2:
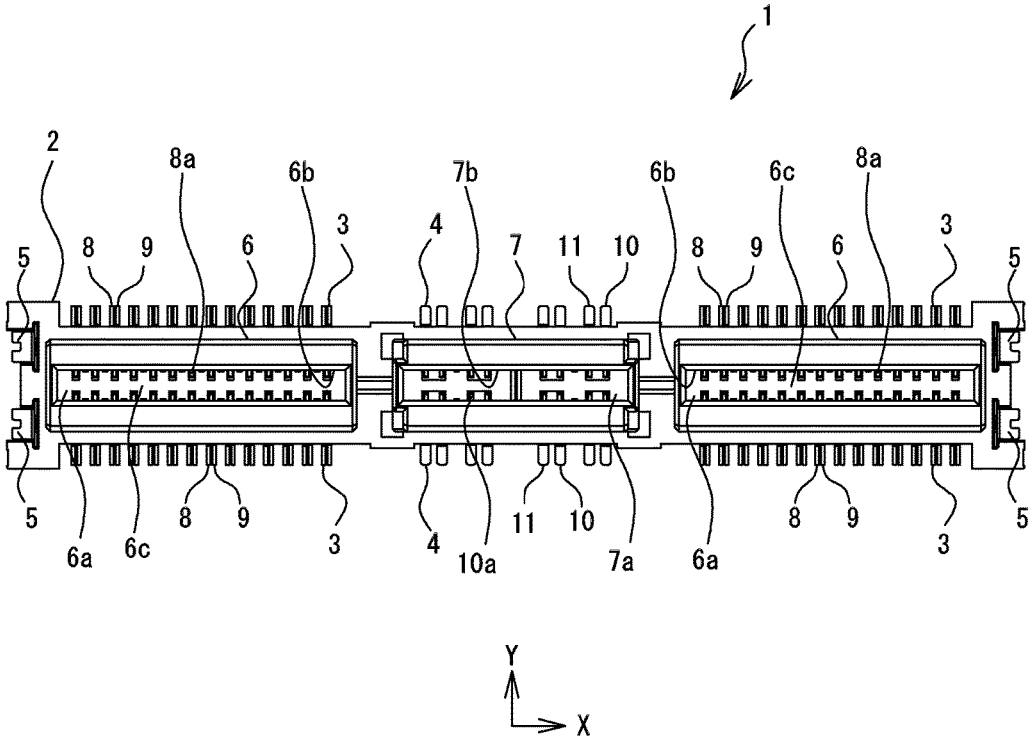
FIG. 2 is a plan view of FIG. 1.
Figure 3:
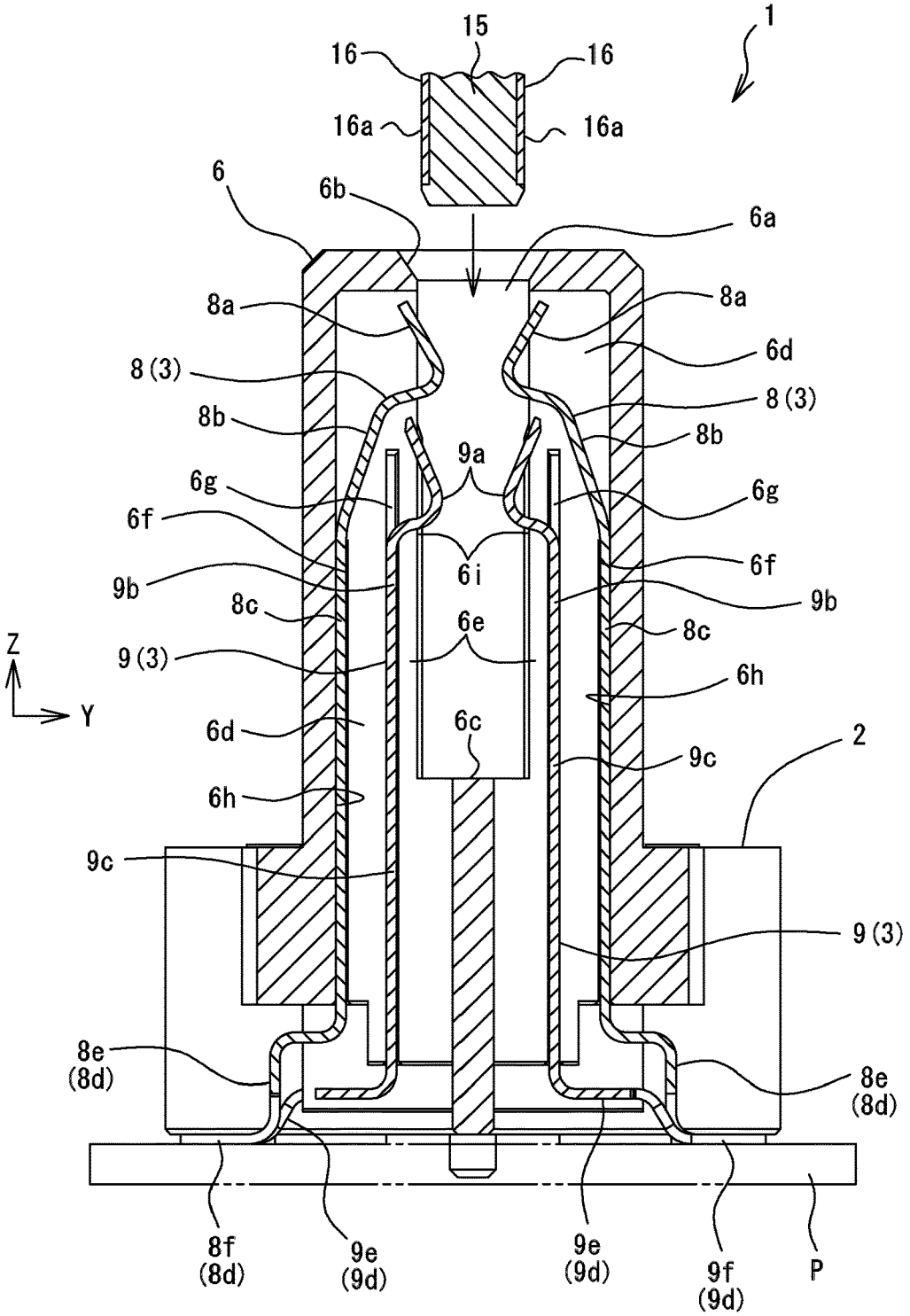
FIG. 3 is a cross-sectional view taken along line in FIG. 1.
Figure 4:
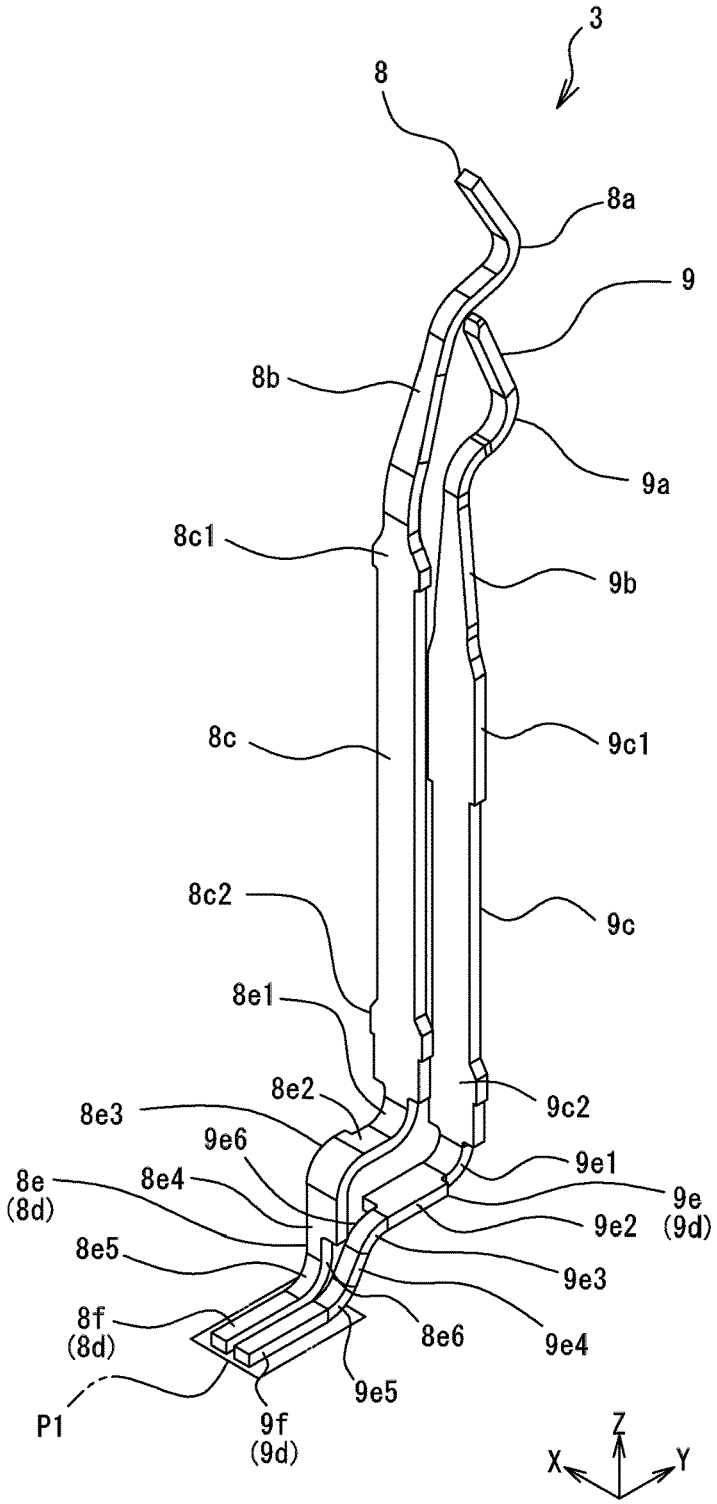
FIG. 4 is an external perspective view including a front view, a right side view, and a plan view of a front terminal and a rear terminal that form a signal multi-contact terminal illustrated in FIG. 1.

Housing 2 (FIGS. 1 to 3)

The housing 2 is formed by a resin molded body, and includes signal connection units 6 on the right and left and a power connection unit 7 in the center.

The signal connection units 6 each include a plurality of signal multi-contact terminals 3 which are arranged side by side along the X direction in such a manner as to form two rows in the Y direction. Similarly, the power connection unit 7 includes a plurality of power multi-contact terminals 4 which are arranged side by side along the X direction in such a manner as to form two rows in the Y direction.

In the signal connection units 6 of the housing 2, a front terminal 8 and a rear terminal 9 forming each of the signal multi-contact terminals 3 are independently arranged without being in contact with each other. Similarly, in the power connection unit 7 of the housing 2, a front terminal 10 and a rear terminal 11 forming each of the power multi-contact terminals 4 are independently arranged without being in contact with each other. Unlike a terminal of the multi-contact connector of the related art, each terminal of the multi-contact connector 1 has no junction where it divides into a front contact and a rear contact. Accordingly, the housing 2 requires no space for accommodating such a junction, and this reduces the size of the multi-contact connector 1.

The signal connection units 6 each include a fitting chamber 6*a*, and the power connection unit 7 includes a fitting chamber 7*a*. The fitting chambers 6*a* and 7*a* are configured to allow a target connector 15 to be inserted and fitted thereinto and to be connected thereto. The fitting chamber 6*a* in each signal connection unit 6 and the fitting chamber 7*a* in the power connection unit 7 are structured in the same way, except for their dimensions. To avoid redundancy, the following description will deal with only one of the signal connection units 6.

The fitting chamber 6*a* in the signal connection unit 6 has an insertion port 6*b* for the target connector 15, and a bottom wall 6*c* located downstream of the insertion port 6*b* in the insertion direction (which is downward in the Z direction). The bottom wall 6*c* limits the insertion of the target connector 15.

The signal connection unit 6 has a plurality of terminal accommodating grooves 6*d* communicating with the fitting chamber 6*a*. The terminal accommodating grooves 6*d* have the same structure. The power connection unit 7 has a plurality of terminal accommodating grooves (not shown) having the same structure as the terminal accommodating grooves 6*d*. The terminal accommodating grooves in the power connection unit 7 are sized to fit the power multi-contact terminals 4.

Adjacent ones of the terminal accommodating grooves 6*d* are separated by partition walls 6*e* that protrude toward the fitting chamber 6*a* in the Y direction. Adjacent ones of the signal multi-contact terminals 3 are thus electrically insulated from each other. An internal space between the partition walls 6*e* facing each other is the fitting chamber 6*a*. The partition walls 6*e* form groove side surfaces along the depth direction of the terminal accommodating grooves 6*d* (i.e., Y direction).

The partition walls 6*e* each have a front-terminal securing groove 6*f* into which a front extending portion 8*c* (described below) of the front terminal 8 of each signal multi-contact terminal 3 is to be press-fitted, and a rear-terminal securing groove 6*g* into which a rear extending portion 9*c* (described below) of the rear terminal 9 of the signal multi-contact terminal 3 is to be press-fitted. The front-terminal securing groove 6*f* and the rear-terminal securing groove 6*g* extend in parallel along the Z direction. The front-terminal securing groove 6*f* and the rear-terminal securing groove 6*g* are formed in each of the partition walls 6*e* facing each other. The front terminal 8 and the rear terminal 9 are thus arranged in such a manner that the flat surface of the front extending portion 8*c* and the flat surface of the rear extending portion 9*c* extend along the width direction of the terminal accommodating groove 6*d* (i.e., X direction) and parallel to each other inside the terminal accommodating groove 6*d*. Thus, the multi-contact connector 1 can be made smaller in size than, for example, the multi-contact connector configured in such a manner that the flat surface of the front extending portion 8*c* and the flat surface of the rear extending portion 9*c* are accommodated side by side in their surface direction along the depth direction of the terminal accommodating groove 6*d* (i.e., Y direction) or along the width direction of the terminal accommodating groove 6*d* (i.e., X direction). Specifically, it is only necessary that the terminal accommodating groove 6*d* be configured to accommodate the thicknesses of the front extending portion 8*c* and the rear extending portion 9*c* parallel to each other. Therefore, the depth of the terminal accommodating groove 6*d* can be made shallower than that in the multi-contact connector of a comparative example where the flat surfaces of the front and rear extending portions are arranged side by side in the depth direction, and thus the housing 2 can be made smaller in size in the Y direction. At the same time, it is only necessary that the terminal accommodating groove 6*d* be configured to accommodate the larger of the widths of the front extending portion 8*c* and the rear extending portion 9*c*. Therefore, the width of the terminal accommodating groove 6*d* can be made narrower than that in the multi-contact connector of another comparative example where the flat surfaces of the front and rear extending portions are arranged side by side in the groove width direction, and thus the housing 2 can be made smaller in size in the X direction.

The front-terminal securing groove 6*f* is formed along a bottom surface 6*h* of the terminal accommodating groove 6*d*. The front terminal 8 is thus disposed in such a manner that one side of the front extending portion 8*c* faces the bottom surface 6*h*. Therefore, since the front contact 8*a* is not displaced beyond the front-terminal securing groove 6*f* toward the bottom surface 6*h*, the terminal accommodating groove 6*d* can be made shallow in the depth direction. The rear-terminal securing groove 6*g* is formed on the side of an opening 6*i* of the terminal accommodating groove 6*d* adjacent to the fitting chamber 6*a*. As in the case of the front terminal 8, the rear contact 9*a* and an elastic arm 9*b* of the rear terminal 9 are displaced toward the front terminal 8, and the rear extending portion 9*c* is not displaced beyond the rear-terminal securing groove 6*g* toward the front terminal 8. This minimizes the distance between the rear-terminal securing groove 6*g* and the front-terminal securing groove 6*f*, and makes the terminal accommodating groove 6*d* shallow in the depth direction.

Signal Multi-Contact Terminals 3 (FIGS. 3 to 5C)

The signal multi-contact terminals 3 are each configured as a terminal pair which is a combination of the front terminal 8 and the rear terminal 9. The front terminal 8 has the front contact 8*a* bent in a rounded V shape, and the rear terminal 9 has the rear contact 9*a* bent in a rounded V shape. The front contact 8*a* and the rear contact 9*a* each form a roll (or curved) surface that protrudes from the opening 6*i* of the terminal accommodating groove 6*d* toward the fitting chamber 6*a*. After the roll surface of the front contact 8*a* contacts a flat terminal surface 16*a* of the target terminal 16 of the target connector 15, the roll surface of the rear contact 9*a* located on a line extending from the front contact 8*a* in the insertion direction of the target connector 15 (i.e., Z direction) contacts the terminal surface 16*a* of the target terminal 16. Thus, since the rear contact 9*a* can contact the terminal surface 16*a* after the front contact 8*a* removes foreign matter (e.g., fibrous substrate debris, dirt, and dust) adhering to the terminal surface 16*a*, electrical conductivity is not impaired by foreign matter and this makes it possible to achieve a highly reliable electrical connection. Also, since the roll surfaces, instead of edges (cut faces), of the front contact 8*a* and the rear contact 9*a* contact the terminal surface 16*a*, plating on the terminal surface 16*a* is not damaged by the contact therewith.

The front terminal 8 has an elastic arm 8*b* that extends at an angle from the bottom surface 6*h* of the terminal accommodating groove 6*d* and connects to the proximal side of the front contact 8*a*. The elastic arm 8*b* serves as a spring piece which causes the front contact 8*a* to be displaced. A distal end of the front extending portion 8*c* disposed along the bottom surface 6*h* connects to the proximal side of the elastic arm 8*b*.

The front extending portion 8*c* is in the shape of a flat plate, and has distal-side front securing bulges 8*c*1 and proximal-side front securing bulges 8*c*2 on both sides thereof. The front extending portion 8*c* is thus secured to the front-terminal securing groove 6*f* at two points which are spaced apart in the length direction. Therefore, the front terminal 8 is prevented from being accidentally rotated even when being pressed into contact with the target connector 15. The front terminal 8 is thus reliably secured to the housing 2. The front extending portion 8*c* has a narrower width at the position of the distal-side front securing bulges 8*c*1 than at the position of the proximal-side front securing bulges 8*c*2. Accordingly, the front-terminal securing groove 6*f* is formed to be narrower at the position where the distal-side front securing bulges 8*c*1 are sandwiched than at the position where the proximal-side front securing bulges 8*c*2 are sandwiched. Thus, since there is no need to press-fit the distal-side front securing bulges 8*c*1 at the beginning of insertion into the front-terminal securing groove 6*f*, the front terminal 8 can be smoothly press-fitted into the front-terminal securing groove 6*f*.

A crank-shaped substrate connecting portion 8*d* is formed on the proximal side of the front extending portion 8*c*. The substrate connecting portion 8*d* includes a leg 8*e* and a contact portion 8*f* soldered to the substrate P. The leg 8*e* includes an upper bent portion 8*e*1, a horizontal piece 8*e*2, an intermediate bent portion 8*e*3, a vertical piece 8*e*4, and a lower bent portion 8*e*5 that connects to the contact portion 8*f*. An edge of the leg 8*e* adjacent to the rear terminal 9 has a recess 8*e*6 which extends from the middle of the vertical piece 8*e*4 to the proximal end of the lower bent portion 8*e*5 to reduce the width of the leg 8*e*. The leg 8*e* has the same width as the contact portion 8*f* in the region having the recess 8*e*6.

The rear terminal 9 has the elastic arm 9*b* which connects to the proximal side of the rear contact 9*a* bent in a rounded V shape. The proximal side of the elastic arm 9*b* connects to the rear extending portion 9*c*.

The rear extending portion 9*c* is formed in the shape of a flat plate, and has distal-side rear securing bulges 9*c*1 and proximal-side rear securing bulges 9*c*2 on both sides thereof. The rear extending portion 9*c* is secured to the rear-terminal securing groove 6*g* at the distal-side rear securing bulges 9*c*1 and the proximal-side rear securing bulges 9*c*2 which are spaced apart in the length direction of the rear extending portion 9*c*. Therefore, the rear terminal 9 is prevented from being accidentally rotated even when being pressed into contact with the target connector 15. The rear terminal 9 is thus reliably secured to the housing 2. The rear extending portion 9*c* has a narrower width at the position of the distal-side rear securing bulges 9*c*1 than at the position of the proximal-side rear securing bulges 9*c*2. Thus, as in the case of the front terminal 8, the rear terminal 9 can be smoothly press-fitted into the rear-terminal securing groove 6*g*.

The distal-side rear securing bulges 9*c*1 are formed to be longer than the proximal-side rear securing bulges 9*c*2 in the length direction of the rear extending portion 9*c*. Therefore, even when the contact pressure of the rear contact 9*a* against the target connector 15 is set high, the distal-side rear securing bulges 9*c*1 having a long press-fit securing length can firmly support the proximal side of the rear contact 9*a*, which creates high contact pressure, without causing the rear-terminal securing groove 6*g* to break.

A crank-shaped substrate connecting portion 9*d* is formed on the proximal side of the rear extending portion 9*c*. The substrate connecting portion 9*d* includes a leg 9*e* and a contact portion 9*f* soldered to the substrate P. The leg 9*e* includes an upper bent portion 9*e*1, a horizontal piece 9*e*2, an intermediate bent portion 9*e*3, an inclined piece 9*e*4, and a lower bent portion 9*e*5 that connects to the contact portion 9*f*. An edge of the leg 9*e* adjacent to the front terminal 8 has a recess 9*e*6 which extends from the distal end of the intermediate bent portion 9*e*3 to the proximal end of the lower bent portion 9*e*5 to reduce the width of the leg 9*e*. The leg 9*e* has the same width as the contact portion 9*f* in the region having the recess 9*e*6.

The recess 9*e*6 and the recess 8*e*6, by which the leg 9*e* and the leg 8*e* are narrowed in width, define a gap between the rear terminal 9 and the front terminal 8. The inclined piece 9*e*4 of the leg 9*e* of the rear terminal 9 extends in such a manner as to pass below the leg 8*e* of the front terminal 8 (i.e., below an edge of the vertical piece 8*e*4 which defines the recess 8*e*6 and extends along the width direction of the front terminal 8), and the lower bent portion 9*e*5 and the contact portion 9*f* running from the inclined piece 9*e*4 extend parallel to the lower bent portion 8*e*5 and the contact portion 8*f* of the front terminal 8. That is, the legs 8*e* and 9*e* have the recesses 8*e*6 and 9*e*6 in the region where their surfaces would overlap if they were arranged in parallel. In other words, the recesses 8*e*6 and 9*e*6 are provided to avoid widening of the substrate connecting portions 8*d* and 9*d*. The substrate connecting portions 8*d* and 9*d* are arranged in parallel only at the lower bent portion 8*e*5 of the leg 8*e* and the contact portions 8*f* and the lower bent portion 9*e*5 of the leg 9*e* and the contact portion 9*f*. This allows the signal multi-contact terminals 3 to be arranged at smaller pitches, and reduces the size of the multi-contact connector 1 in the X direction.

Figure 6:
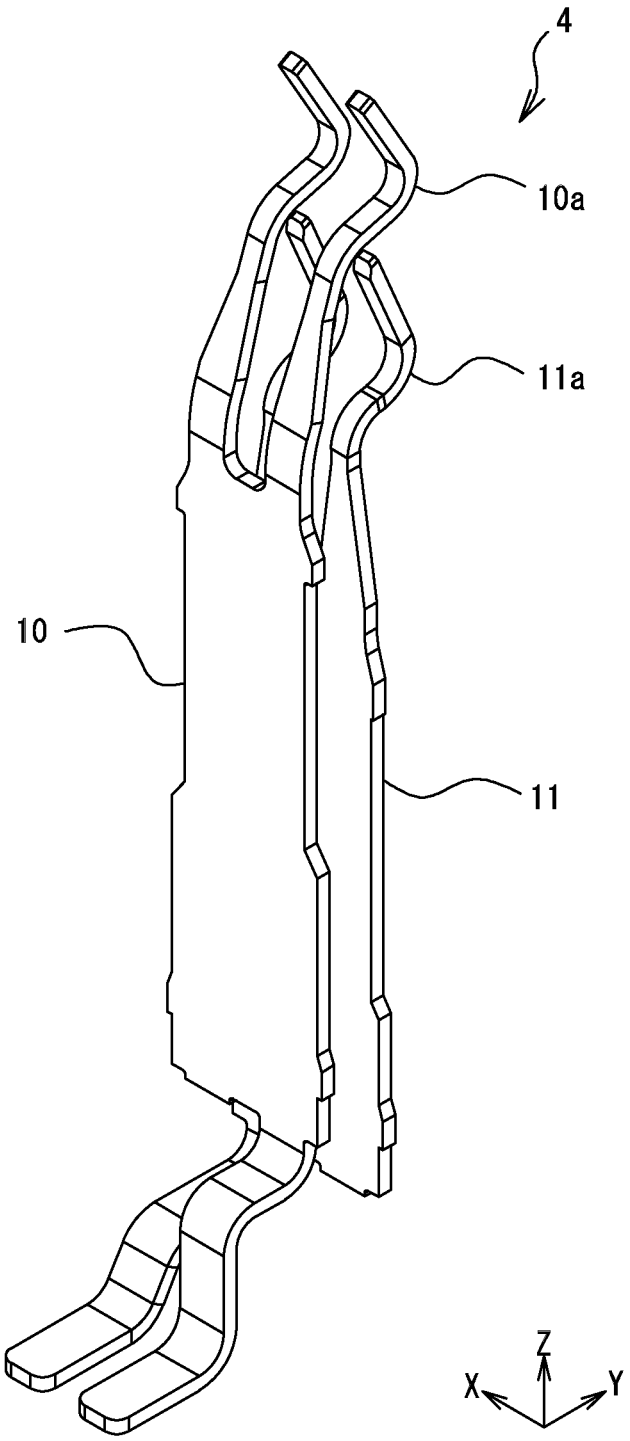
FIG. 6 is an external perspective view including a front view, a right side view, and a plan view of a front terminal and a rear terminal that form a power multi-contact terminal illustrated in FIG. 1.

Power Multi-Contact Terminals 4 (FIG. 6)

The power multi-contact terminals 4 have basically the same configuration as the signal multi-contact terminals 3 and redundant explanations will be omitted. The power multi-contact terminals 4 differ from the signal multi-contact terminals 3 in that a front contact 10*a* of the front terminal 10 and a rear contact 11*a* of the rear terminal 11 are each bifurcated into two parts. The front contact 10*a* and the rear contact 11*a* having a bifurcated shape allow a large current to flow through. Also, even if one of the two parts of the bifurcated contact fails to make contact with the target connector 15, the other can successfully make contact therewith, and this improves reliability of electrical contact.

Use of Multi-Contact Connector 1

The multi-contact connector 1 configured as described above is electrically connected and secured to the circuit on the substrate P by being soldered, to the substrate P, at the contact portions 8*f* and 9*f* of the signal multi-contact terminals 3, the contact portions of the power multi-contact terminal 4, and metal fasteners 5 on both sides of the housing 2 in the X direction.

Figure 5A:
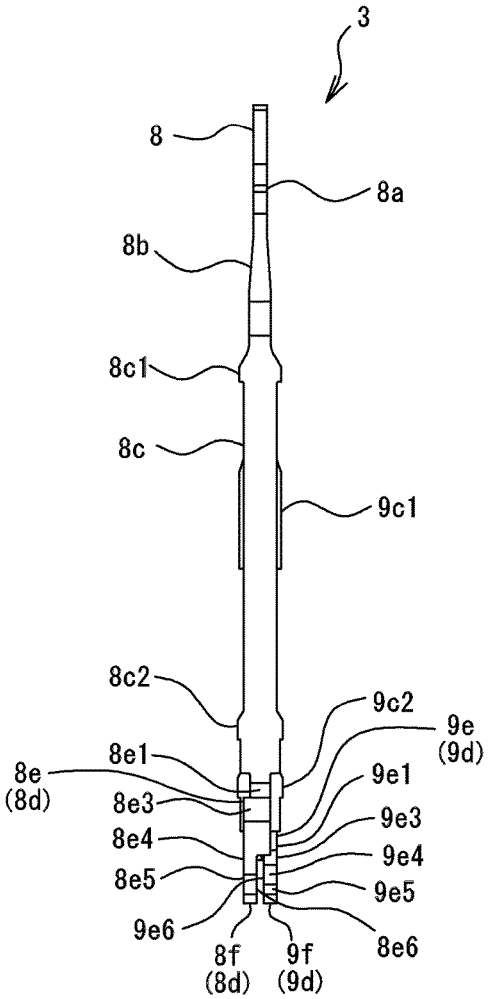
FIG. 5A is a front view of the front terminal and the rear terminal illustrated in FIG. 4.
Figure 5B:
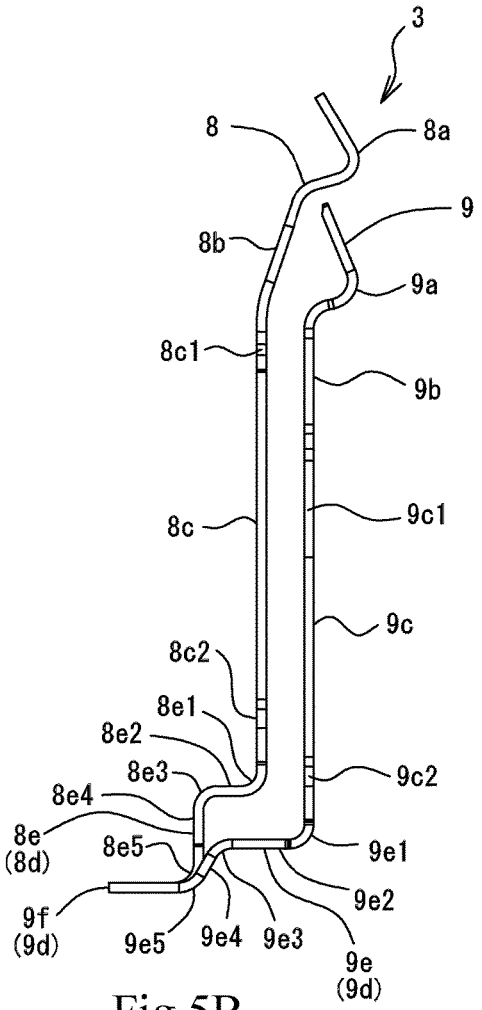
FIG. 5B is a right side view of the same.
Figure 5C:
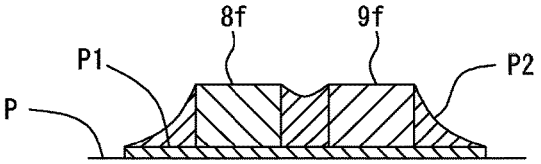
FIG. 5C is a cross-sectional view of a soldering portion by which contact portions are soldered to a circuit contact point on a substrate.

As illustrated in FIG. 5C, the contact portion 8*f* of the front terminal 8 and the contact portion 9*f* of the rear terminal 9 are electrically connected by a soldering portion P2 to one circuit contact point P1 on the substrate P. Therefore, even if one of the contact portions 8*f* and 9*f* of the front and rear terminals 8 and 9 fails to make electrical contact with the circuit contact point P1, the other can maintain the electrical connection and this makes it possible to maintain high connection reliability. Also, since the contact portions 8*f* and 9*f* are soldered together to one circuit contact point P1, the peeling strength of the soldering portion P2 is improved.

When the target connector 15 is inserted through the insertion ports 6*b* and 7*b* into the fitting chambers 6*a* and 7*a* of the housing 2, the terminal surfaces 16*a* of the target terminals 16 contact the front contacts 8*a* of the front terminals 8 and then the rear contacts 9*a* of the rear terminals 9. Since the front contacts 8*a* keep sliding contact with the terminal surfaces 16*a* during this operation, the front contacts 8*a* can wipe off and remove foreign matter adhering to the terminal surfaces 16*a*. This improves contact reliability of at least the rear contacts 9*a*.

As described above, the front terminal 8 and the rear terminal 9 forming a pair are independently and separately arranged in one terminal accommodating groove 6*d* having the same width as the front terminal 8 and the rear terminal 9. Therefore, while the multi-contact connector 1 has a wiping mechanism realized by the multi-contact terminals 3 and 4, the overall size of the multi-contact connector 1 is reduced.

Ideally, the target connector 15 is inserted in a straight line into the fitting chambers 6*a* and 7*a*. However, the target connector 15 is often inserted at an angle into the fitting chambers 6*a* and 7*a*, and insertion forces from various directions act on the multi-contact connector 1. If the legs 8*e* of the front terminals 8 and the legs 9*e* of the rear terminals 9 have the same shape, all the legs 8*e* and 9*e* deform in the same way and this makes it difficult to accommodate the insertion forces from various directions. This may result in concentration of stress on the soldering portions P2 and may produce defects, such as cracks.

In the multi-contact connector 1 of the present embodiment, however, the legs 8*e* and 9*e* of the front and rear terminals 8 and 9 forming a pair are configured to partly extend in different directions. Specifically, the rear terminal 9 includes the inclined piece 9*e*4, which is absent in the leg 8*e* of the front terminal 8. Therefore, even if the target connector 15 is inserted in the housing 2 at an angle, the housing 2 can be supported by at least one of the legs 8*e* and 9*e*, which partly extend in different directions. This relieves the concentration of stress on the soldering portions P2, and the insertion forces from various directions can be accommodated by the legs 8*e* and 9*e*.

What is claimed is:

1. A multi-contact connector comprising:

a housing having a fitting chamber into which a connection object is to be inserted;

a front terminal including a flat plate-shaped front extending portion held by the housing, and a front contact configured to contact the connection object inserted into the fitting chamber; and a rear terminal including a flat plate-shaped rear extending portion held by the housing, and a rear contact located on a line extending from the front contact in an insertion direction of the connection object, wherein the housing has one terminal accommodating groove communicating with the fitting chamber and configured to accommodate the front terminal and the rear terminal together in such a manner that the front terminal and the rear terminal are in a separate state, each of the front terminal and the rear terminal includes a leg respectively and a contact portion electrically connected to one circuit contact point on a substrate, an edge of the leg of the front terminal adjacent to the leg of the rear terminal has a recess which reduces the width of the leg of the front terminal, the leg of the rear terminal extends in such a manner as to pass below the recess of the front terminal; and the contact portion of the front terminal and the contact portion of the rear terminal are arranged in parallel to be connected to the circuit contact point.

2. The multi-contact connector according to claim 1, wherein the contact portion of the front terminal and the contact portion of the rear terminal are soldered to the circuit contact point and the leg of the front terminal is partly extending in a first direction, and the leg of the rear terminal is partly extending in a second direction different from the first direction.

3. The multi-contact connector according to claim 1, wherein the terminal accommodating groove is configured to accommodate the front terminal and the rear terminal in such a manner that a flat surface of the front extending portion and a flat surface of the rear extending portion extend along a width direction of the terminal accommodating groove and face each other.

4. The multi-contact connector according to claim 1, wherein the terminal accommodating groove has a rear-terminal securing groove disposed adjacent to an opening of the terminal accommodating groove communicating with the fitting chamber, the rear-terminal securing groove being configured to allow the flat plate-shaped rear extending portion to be press-fitted thereinto in such a manner that a surface of the flat plate-shaped rear extending portion extends along a width direction of the terminal accommodating groove; and a front-terminal securing groove disposed closer to a bottom surface of the terminal accommodating groove than the rear-terminal securing groove is, the front-terminal securing groove being configured to allow the flat plate-shaped front extending portion to be press-fitted thereinto in such a manner that a surface of the flat plate-shaped front extending portion extends along the width direction of the terminal accommodating groove.

* * * * *